US006634329B2

(12) United States Patent
Kusano et al.

(10) Patent No.: US 6,634,329 B2
(45) Date of Patent: Oct. 21, 2003

(54) APPARATUS FOR CONTROLLING VALVE TIMING OF ENGINE

(75) Inventors: Shigeyuki Kusano, Kariya (JP); Hirohiko Yamada, Okazaki (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 10/107,416

(22) Filed: Mar. 28, 2002

(65) Prior Publication Data

US 2002/0139333 A1 Oct. 3, 2002

(30) Foreign Application Priority Data

Mar. 29, 2001 (JP) ..... 2001-096525

(51) Int. Cl.[7] ..... F01L 1/34

(52) U.S. Cl. ..... 123/90.17; 123/90.15; 123/90.18

(58) Field of Search ..... 123/90.11–90.18, 123/90.31

(56) References Cited

U.S. PATENT DOCUMENTS 5,870,983 A * 2/1999 Sato et al. ..... 123/90.17
6,386,164 B1 * 5/2002 Mikame et al. ..... 123/90.17
6,397,803 B1 * 6/2002 Fujiwara et al. ..... 123/90.15
6,505,586 B1 * 1/2003 Sato et al. ..... 123/90.17

FOREIGN PATENT DOCUMENTS

JP 9-324613 12/1997

OTHER PUBLICATIONS

U.S. patent application Ser. No. 10/107,148, filed Mar. 28, 2002, "Variable Valve Timing Apparatus".

* cited by examiner

*Primary Examiner*—Thomas Denion
*Assistant Examiner*—Kyle Riddle
(74) *Attorney, Agent, or Firm*—Nixon & Vanderhye P.C.

(57) ABSTRACT

A valve timing control apparatus has a variable valve timing actuator. The system advances the valve timing to at least a middle position before the engine is completely stopped. The middle position is appropriate to start the engine. Before stopping the engine, if the oil temperature is too high to maintain a viscosity, the system provides a control to assist the above-described advancing control. For instance, the system increases the engine speed to supply a sufficient amount and pressure of oil. The system slightly advances the valve timing while the engine is in an idling.

27 Claims, 6 Drawing Sheets

APPARATUS FOR CONTROLLING VALVE TIMING OF ENGINE

CROSS REFERENCE TO RELATED APPLICATION

This application is based on Japanese Patent Application No. 2001-96525 filed on Mar. 29, 2001 the contents of which are incorporated herein by reference.

BACKGROUND OF THE INVENTION

1. Field of the Invention

The present invention relates to an apparatus for controlling a valve timing, which controls at least one of valve timings of an intake valve and an exhaust valve of an internal combustion engine.

2. Description of Related Art

An apparatus for controlling a valve timing of an internal combustion engine is known in the art. The apparatus has a driving member rotating with a crankshaft (driving shaft) of the engine and a driven member rotating with a camshaft (driven shaft). The apparatus changes valve timing by rotating the driven member relative to the driving member using pressurized oil or the like. The apparatus controls the valve timing so as to improve an output of the engine or a fuel economy.

Hereinafter, the case of controlling an intake valve is explained. It is well known that closing the intake valve after the bottom dead center is effective to reduce the pumping loss of the intake air and to improve fuel economy. This valve timing is effective after the engine is warmed up. However, in a cold condition of the engine, this valve timing decreases an actual compression ratio and decreases a temperature of a compressed air at the top dead center. Therefore, this valve timing makes it difficult to start the engine.

It is also known in the art that the valve timing control apparatus can lock the valve timing at a position between a most advanced position and a most retarded position when starting the engine.

To locate the driven member in a starting position which is appropriate for starting the engine when the engine is started, it is desirable that the driven member is previously operated to the starting position or a position more advanced when the engine is stopped.

However, an engine speed is an idling speed or below when the engine is stopped. Therefore, it is difficult to supply a sufficient oil to operate the driven member. Moreover, in case of high oil temperature, it is more difficult to supply a sufficient amount and pressure of oil.

Meanwhile, it is desirable that an overlap period of the intake valve and the exhaust valve is relatively long to obtain stable combustions during an idling. Further, relatively retarded valve timing is desirable during the idling to reduce an improper combustion such as a knocking caused by a quick operation of an accelerator. Therefore, the starting position or more advanced position is undesirable in the idling.

SUMMARY OF THE INVENTION

An object of the present invention is to provide an improved apparatus for controlling a valve timing of an internal combustion engine.

Another object of the present invention is to provide an apparatus for controlling a valve timing, which can easily obtain a starting position that is appropriate for starting the engine.

A further object of the present invention is to provide an apparatus for controlling a valve timing, which can easily obtain the starting position even when oil is at a high temperature.

A still another object of the present invention is to provide an apparatus for controlling a valve timing, which can easily obtain the starting position with maintaining stable combustions during an idling.

According to a first aspect of the present invention, an apparatus for controlling a valve timing of an engine has a means for preparing an advancing control of the advancing means before the engine is stopped, the means controlling the engine into a condition that helps to advance the valve timing by the advancing means. The preparing means provides an advantageous condition that is effective to advance the valve timing when the engine is stopped. Therefore, if the operator operates the engine to stop, the engine is already in the condition preparing to advance the valve timing. As a result, the apparatus easily obtains an advanced valve timing that is close to the starting position when the engine is stopped.

According to another aspect of the present invention, an assist spring or a control means for a hydraulic actuator may be used for advancing the valve timing when the engine is stopped. The assist spring assists the camshaft to rotate in the advance direction. The control means controls the hydraulic actuator to rotate the camshaft in the advance direction.

According to a still another aspect of the present invention, advancing the valve timing may be helped by increasing an engine speed, advancing the valve timing previously, or decreasing a temperature of an oil supplied to the hydraulic actuator. For example, these preparations may be executed when the engine is in an idling since the engine is usually stopped from the idling.

According to a further aspect of the present invention, the valve timing may be advanced previously till combustion of the engine becomes unstable. Therefore, the combustion is kept in stable condition even if the valve timing is advanced during the engine is in the idling.

According to a still further aspect of the present invention, the variable valve timing actuator may include a lock mechanism which mechanically locks the camshaft and the crankshaft in the middle position.

BRIEF DESCRIPTION OF THE DRAWINGS

Features and advantages of embodiments will be appreciated, as well as methods of operation and the function of the related parts, from a study of the following detailed description, the appended claims, and the drawings, all of which form a part of this application. In the drawings:

DETAILED DESCRIPTION OF PREFERRED EMBODIMENTS

Embodiment of the present invention will be explained with reference to the figures.

First Embodiment

Figure 1:
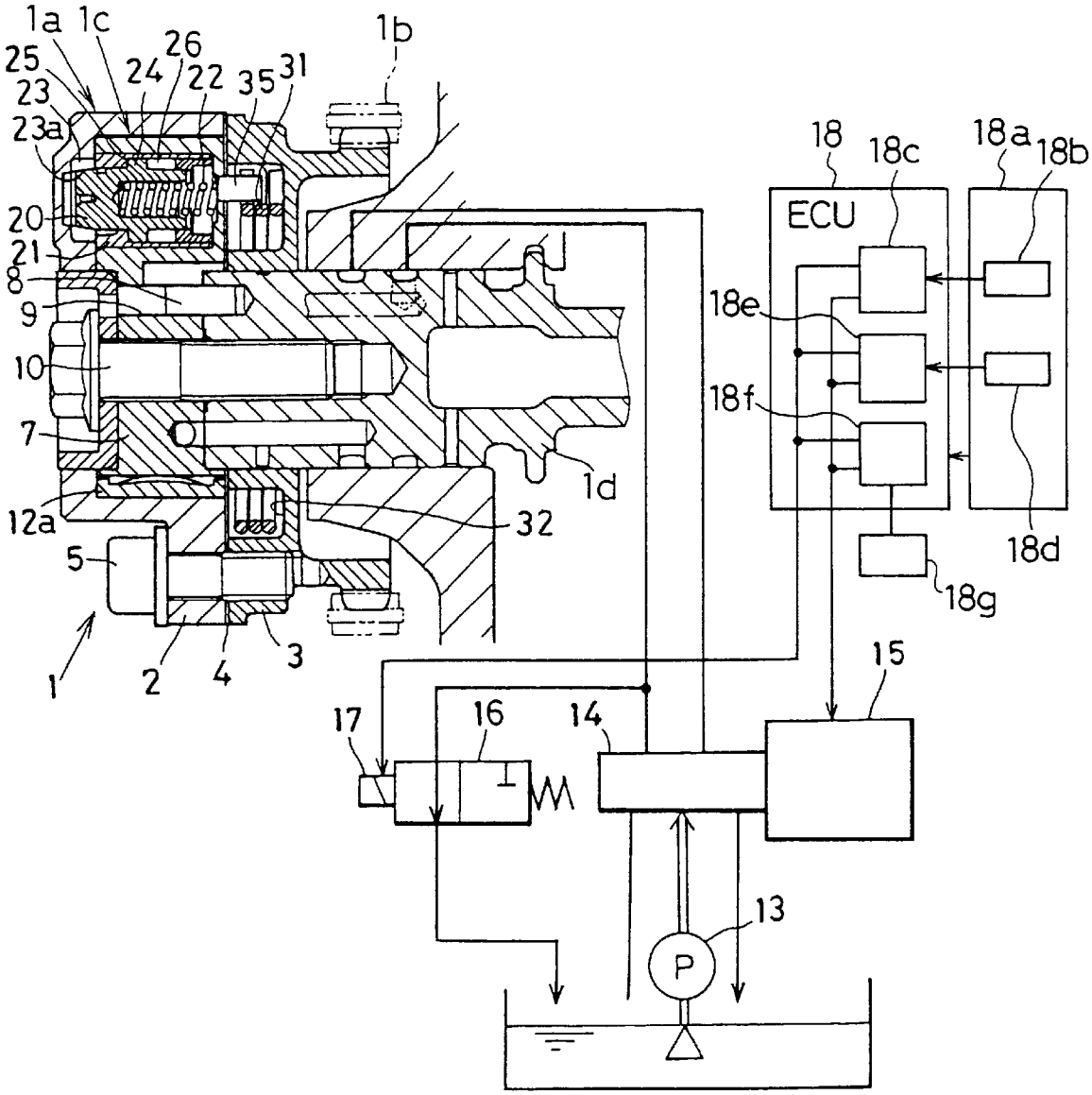
FIG. 1 is a block diagram of an apparatus for controlling a valve timing of an engine according to a first embodiment of the present invention.
Figure 2:
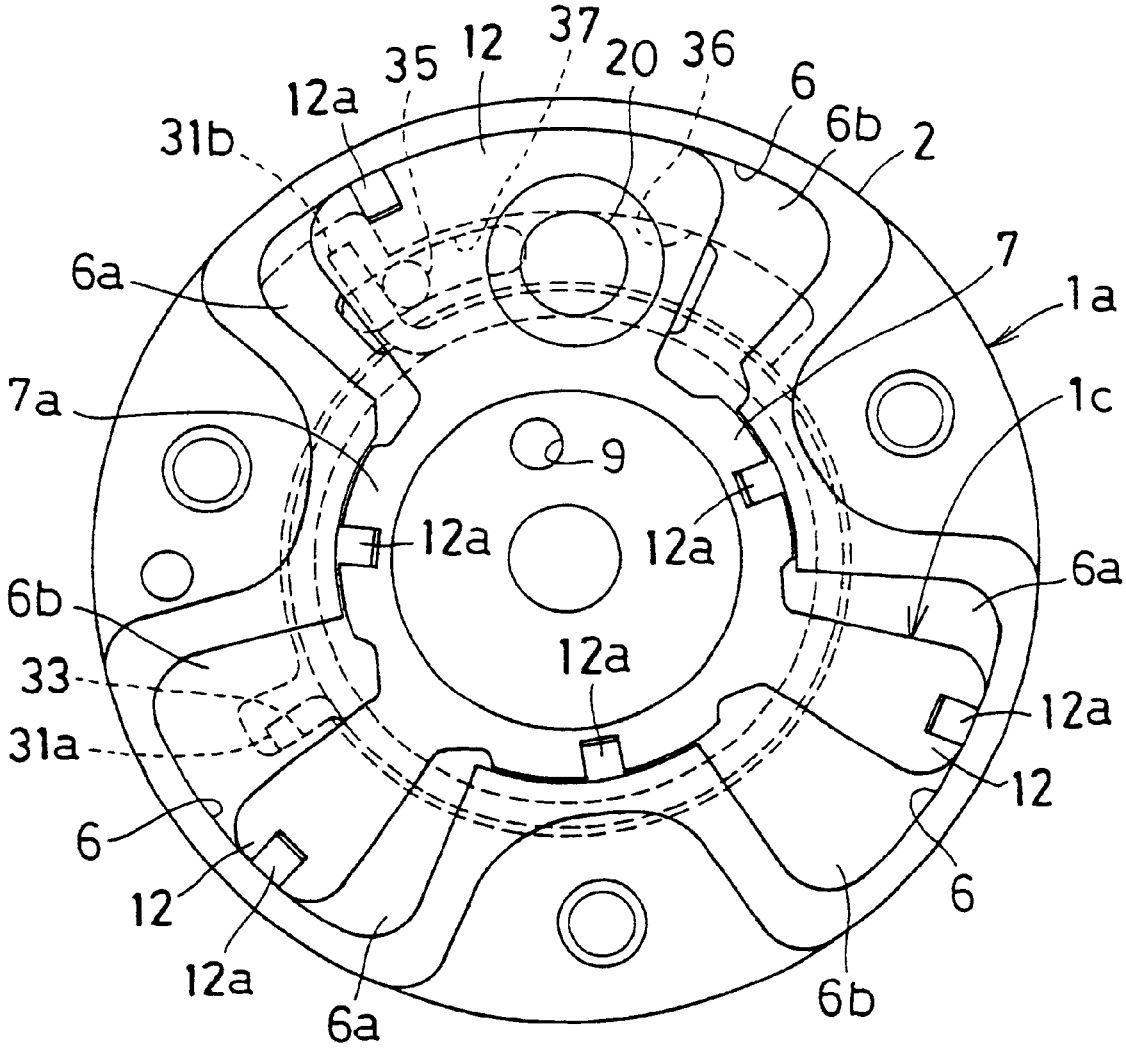
FIG. 2 is a sectional view of a valve timing actuator according to the first embodiment of the present invention.
Figure 3:
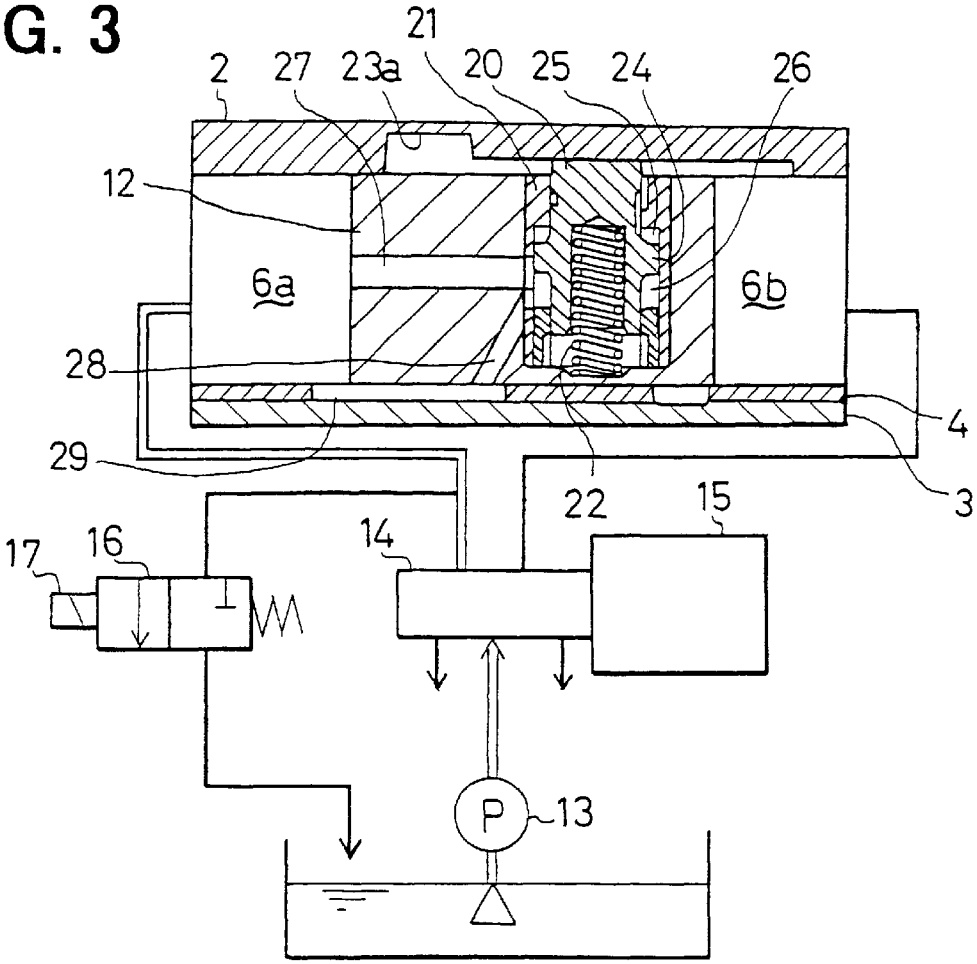
FIG. 3 is a block diagram showing a lock mechanism according to the first embodiment of the present invention.
Figure 4:
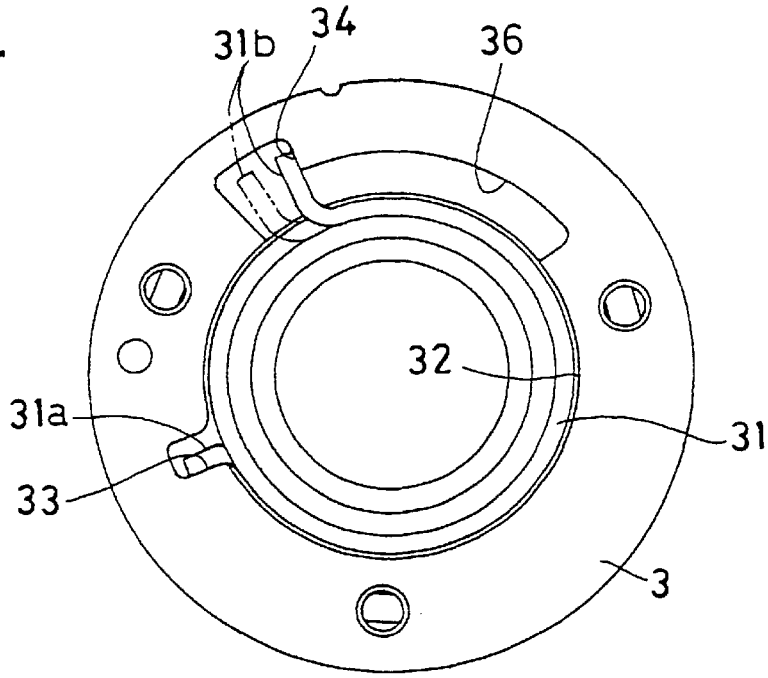
FIG. 4 is a sectional view of a valve timing actuator according to the first embodiment of the present invention.

FIG. 1 shows a longitudinal section of variable valve timing actuator 1, an oil system and an electronic control system. FIG. 2 shows a transverse section of the variable valve timing actuator 1. FIG. 3 shows a schematic view of a lock mechanism. FIG. 4 shows an assist spring 31.

In this embodiment, the variable valve timing actuator (VVT) 1 is mounted on a camshaft that operates intake valves of a double overhead camshaft type engine. The VVT 1 varies the valve timing continuously. Referring to FIG. 1, a left side is referred to as a front side and a right side is referred to as a rear side in this embodiment.

The VVT 1 has a driving member 1*a* that is driven by a crankshaft via a timing chain 1*b* or a timing belt. The driving member 1*a* is arranged to be relatively movable with a driven member 1*c* that is connected with a camshaft 1*d*. The VVT 1 has a hydraulic actuator for rotating the driving member 1*a* and driven member 1*c* relatively. As a result, a rotating phase of the camshaft 1*d* can be relatively advanced or retarded to the crankshaft.

The driving member 1*a* has a shoe housing 2, a sprocket 3 and a seal plate 4 disposed therebetween. The shoe housing 2 defines at least one oil chamber therein. The seal plate 4 seals a rear side of the oil chamber. The shoe housing 2, the sprocket 3 and the seal plate 4 are tightened by a plurality of bolts 5. The driving member 1*a* rotates in the clockwise direction in FIG. 2. In FIG. 2, clockwise rotation of the driven member 1*c* is an advancing movement. The shoe housing 2 defines a center cavity and a plurality of fan-shaped cavities. In this embodiment three fan-shaped cavities 6 are provided in the shoe housing 2.

The driven member 1*c* has a vane rotor 7 that is fixed on the camshaft 1d by a bolt 10 to rotate together. The vane rotor 7 has a positioning hole 9 that receives a positioning pin 8 fixed on an axial end of the camshaft 1d. The vane rotor 7 has a center hub portion 7*a* and a plurality of vanes 12. Each vane 12 is disposed in the fan-shaped cavity 6 and divides it into an advance chamber 6*a* and a retard chamber 6*b*. The vane rotor 7 is relatively rotatable to the shoe housing 2 within a predetermined angular range. The advance and retard chambers 6*a* and 6*b* are oil chambers defined by the shoe housing 2, the seal plate 4 and the vane rotor 12 and act as the hydraulic actuator. Each of the chambers is sealed by a plurality of sealing members 12*a* disposed in grooves located on the vane 12 and the center hub 7*a*. The advance chambers 6*a* are located behind the vanes 12 with respect to the rotating direction of the shoe housing 2. The retard chambers 6*b* are located in front of the vanes 12 with respect to the rotating direction of the shoe housing 2. When oil is supplied into the advance chambers 6*a* and discharged from the retard chambers 6*b*, the valve timing is advanced. On the contrary, when the oil is supplied into the retard chambers 6*b* and discharged from the advance chambers 6*b*, the valve timing is retarded.

The VVT 1 has a lock mechanism for locking the shoe housing 2 and the vane rotor 7 by a pin 20 at a position located between a most advance position and a most retard position. The lock position is referred to as a middle position. In this embodiment, the middle position is located 10° (degree) advancing from the most retarded position.

The widest vane 12 has a pin 20 for stopping the rotation of the vane rotor 7 at the middle position. The pin is housed in a hole formed in the vane 12. The pin 20 is supported in the hole by the stopper ring 21 so as to be movable in an axial direction. The stopper ring 21 also restricts axial movement of the pin 20. A coil spring 22 is disposed behind the pin 20 for urging the pin 20 toward the front side so that the pin 20 engages with the shoe housing 2. The shoe housing 2 has a bush 23. The bush 23 defines a hole 23*a* for receiving a distal end of the pin 20 when the pin 20 protrudes toward the front side. Therefore, the shoe housing 2 and the vane rotor 7 are locked when the pin 20 engages with the bush 23.

The shoe housing 2 further defines an oil passage (not shown) that faces the distal end of the pin 20 for applying an oil pressure to urge the pin 20 toward the rear side, in an unlocking direction. The passage introduces the oil from the retard chamber 6*b*. Therefore the pin 20 unlocks the vane rotor 7 when the retard chamber 6*b* is supplied with a sufficient amount and pressure of oil. The pin 20 has a flange 24 on its middle portion. The flange 24 receives oil pressures on the both sides. The pin 20 and the stopper ring 21 define an unlock chamber 25 that faces a front side of the flange 24. The unlock chamber 25 urges the pin 20 in the unlocking direction. The pin 20 and the stopper ring 21 also define a lock chamber 26 that faces a rear side of the flange 24. The lock chamber 26 urges the pin 20 in the locking direction.

The unlock chamber 25 communicates with the retard chamber 6*b* while the pin 20 unlocks the vane rotor 7 via passages formed between the pin 20 and the stopper ring 21. The lock chamber 26 communicates with the advance chamber 6*a* via a lateral passage 27 formed in the vane 12 and a longitudinal passage. The longitudinal passage has an inclined passage 28 formed in the vane 12 and a groove 29 formed on the seal plate 4. The inclined passage 28 communicates with the advance chamber 6*a* via the groove 29 while the vane rotor 7 is positioned in an advanced range as shown in FIG. 3. However, the inclined passage 28 is disconnected with the advance chamber 6*a* when the vane rotor 7 is positioned within a predetermined range close to the most retard position. An aperture on the seal plate 4 provides the groove 29.

The VVT 1 has an assisting means for assisting a relative rotation of the vane rotor 7 advancing toward the middle position where the pin 20 locks the vane rotor 7. The means has an assist spring 31 that is a twisted coil spring for urging the driven member 1*c* in the advance direction relative to the driving member 1*a*. The assist spring 31 urges the vane rotor 7 to rotate toward the middle position only when the vane rotor 7 is in a retarded range between the middle position and the most retard position. The assist spring 31 doesn't act between the shoe housing 2 and the vane rotor 7 during the vane rotor 7 is in an advanced range between the middle position and the most advance position.

The assist spring 31 is housed in a spring container 32 formed in the sprocket 3 that is made of hard material, as shown in FIG. 1. A first end 31*a* of the assist spring 31 is received and hooked in a hooking groove 33 formed in the sprocket 3. A second end 31*b* of the assist spring 31 is received in a wider groove 34. The second end 31*b* is movable within a predetermined angular range corresponding to the retarded range defined by the wider groove 34. On the opposite side, a pin 35 is fixed on a rear side surface of the vane rotor 7. The pin 35 is arranged to come into contact with the second end 31*b* of the assist spring 31 while the vane rotor 7 is in the retarded range. The sprocket 3 provides a groove 36 for receiving the pin 35. The seal plate 4 has an arc-shaped aperture 37 through which the pin 35 passes. The aperture 37 allows the pin 35 to freely move from the most retarded position to the most advanced position. According to the above-described embodiment, the assist spring 31 acts to urge the vane rotor 7 in the advance direction only when the vane rotor 7 is in the retarded range.

The apparatus has an oil control means for controlling a supply and discharge from the chambers 6*a* and 6*b*. Referring to FIGS. 1 and 3, the means has a pump 13 driven by the crankshaft, a first valve 14 and a second valve 16. The first valve 14 is operated by an electromagnetic actuator 15, and controls an oil supply and discharge of the chambers 6*a* and 6*b*. The vane 7 rotates in the advance direction when the first valve 14 connects the advance chambers 6*a* to the pump 13 and connects the retard chamber 6*b* to a drain. The vane 7 rotates in the retard direction when the first valve 14 connects the advance chambers 6*a* to the drain and connects the retard chamber 6*b* to the pump 13. The second valve is operated by an electromagnetic actuator 17, and controls an oil discharge from the advance chamber 6*a*, The second valve 16 can connect the advance chambers 6*a* to the drain when the first valve 14 connects the retard chambers 6*b* to the drain. The apparatus further has an electronic control unit (ECU) 18 that is a microcomputer having a CPU, RAM, ROM, I/O port and so on. The ECU 18 detects an engine operating condition based on a plurality of signals from sensors 18*a*. The sensors 18*a* includes a crank angle sensor, an engine speed sensor, an accelerator operating degree sensor and the like. The ECU 18 executes a predetermined program to control the electromagnetic actuators 15 and 17 to provide appropriate valve timings with respect to the detected operating condition of the engine.

Next, operations of the system when the engine is stopped and when the engine is started will be described.

When the operator (driver) operates the engine to stop, e.g. turns off an ignition key switch 18*b*, a stopping control means 18*c* outputs driving signals for the electromagnetic actuators 15 and 17 to communicate the retard chamber 6*b* to drain and to communicate the advance chamber 6*a* to the pump 13. After the ignition key switch 18*b* is turned off, the engine speed falls from the idling speed, but the pump 13 still supplies the oil. Therefore, the vane rotor 7 rotates in the advance direction. Additionally, the assist spring 31 urges the vane rotor 7 in the advance direction when the vane rotor 7 is in the retarded range. Therefore, the vane rotor 7 may rotate to the advanced range even if the oil pressure is lowering. The oil in the advance chamber 6*a* is introduced into the lock chamber 26 via the passage 27, 28 and 29. Therefore, the pin 20 is urged so that the distal end of the pin 20 comes in contact with the shoe housing 2 or the distal end of the pin 20 engages with the hole 23*a*. Then, the engine is completely stopped. In this embodiment, the stopping control means 18*c* and the assist spring 31 perform as a advancing means for advancing the valve timing to at least the middle position when the engine is stopped.

When the operator operates the engine to start, e.g. turns on a starter switch 18*d*, a starting control means 18*e* outputs driving signals for the electromagnetic actuators 15 and 17 to communicate the advance chamber 6*a* and the retard chamber 6*b* with the drain. During a cranking of the engine by a starter motor, the engine speed is too low to supply sufficient oil by the pump 13. However, in this embodiment, the vane rotor 7 is previously rotated to the lock position or the advance range when the engine is stopped. Therefore, the pin 20 locks the vane rotor 7 during the cranking of the engine. If the vane rotor 7 is in the advance range when the cranking begins, since the vane rotor 7 is always urged in the retard direction by a reaction of valve springs, the vane rotor 7 rotates in the retard direction and the pin 20 urged by the spring 22 engages with the hole 23*a* automatically. As a result, the cranking of the engine is carried out under the condition where the vane rotor 7 is locked in the middle position. That is, the valve timing is locked in a valve timing that is appropriate for starting the engine during the cranking.

The ECU 18 further has a preparing means 18*f* for helping the stopping control means to rotate the vane rotor 7 to the advance range more easily. Since an oil viscosity decreases as the oil temperature increases, the oil pressure decreases as the oil temperature increases. Therefore, if the oil temperature is high, the stopping control means may not be able to rotate the vane rotor 7 to the advance range. To reduce this problem, the ECU 18 has the preparing means 18*f*. The preparing means 18*f* controls the actuators 15 and 17 to rotate the vane rotor 7 to an advanced position that is slightly advanced from the most retarded position when the oil temperature is high. The preparing means 18*f* further controls an idle control device 18*g* to increase the engine speed when the oil temperature is high.

Figure 5:
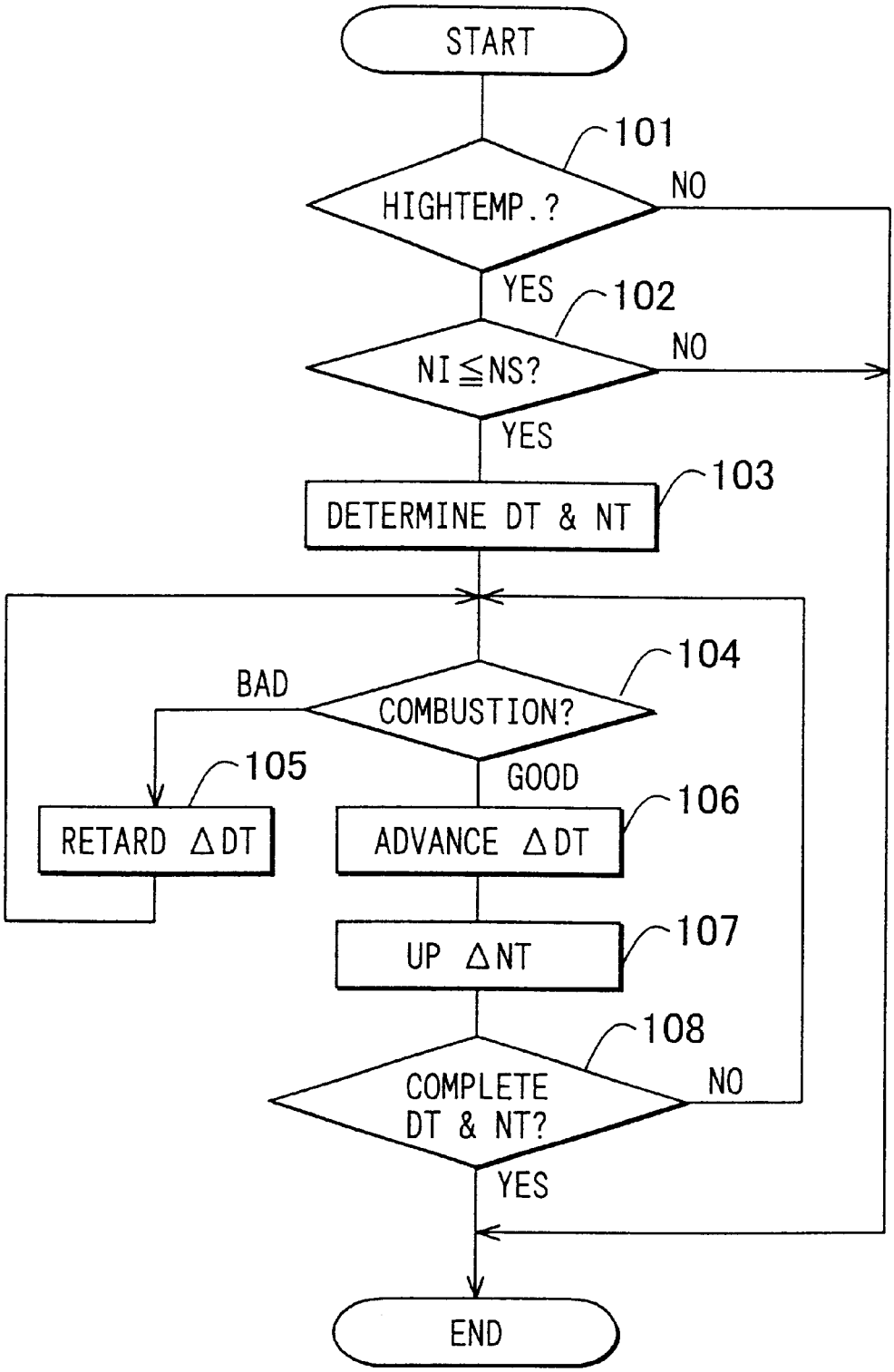
FIG. 5 is a flowchart showing a process in a high oil temperature condition according to the first embodiment of the present invention.

The preparing means 18*f* executes a program as shown in FIG. 5. In a step 101, the ECU 18 determines whether a detected oil temperature To is higher than a predetermined temperature Tt. In a step 102, the ECU 18 determines whether the engine is in the idling and the engine speed NI is lower than the predetermined engine speed NS. That is, the ECU 18 determines whether the engine is in a condition where the oil pressure may lower, e.g. the engine is in the idling and a transmission is in a drive range.

If the oil temperature is high, the engine is in the idling, and the engine speed is low, the routine proceeds to a step 103. In the step 103, a target advance degree DT of the vane rotor 7 and a target idle-up degree NT are determined. The target values DT and NT may be calculated based on the detected oil temperature, or determined by looking up predetermined maps.

Figure 6:
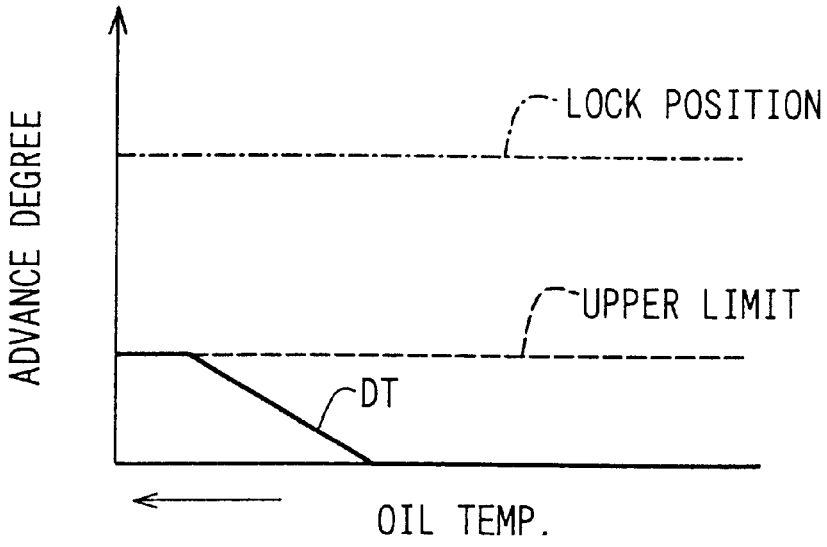
FIG. 6 is a graph showing an advance degree in relation to an oil temperature according to the first embodiment of the present invention.

In this embodiment, the target advance degree DT is determined based on a predetermined characteristic as shown in FIG. 6. The target advance degree DT is increased as the oil temperature increases so that the vane rotor 7 approaches to the lock position as the oil pressure lowers. This characteristic may help to rotate the vane rotor 7 to the advance range even in a low oil pressure. The target advance degree DT is limited under an upper limit. If the advance degree increases more than the upper limit when the engine is in the idling and is warmed up, an overlap of the intake and exhaust valve may reach inappropriate length, combustion condition may be deteriorated.

Figure 7:
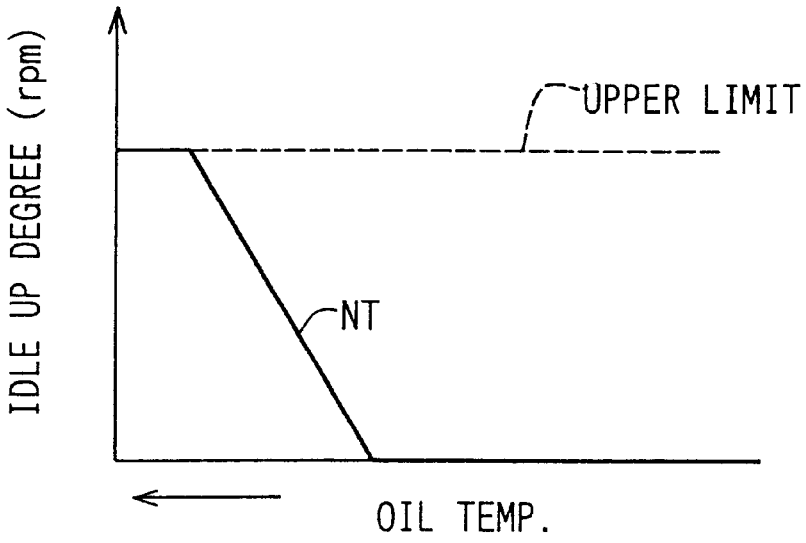
FIG. 7 is a graph showing an idling up degree in relation to an oil temperature according to the first embodiment of the present invention.

The target idle-up degree NT is determined based on a predetermined characteristic as shown in FIG. 7. The target idle-up degree NT is increased as the oil temperature increases. This characteristic may increase the oil pressure by increasing a rotating speed of the pump 13 and help to rotate the vane rotor 7 to the advance range after the ignition key switch 18*b* is turned off. The target idle-up degree NT is limited under an upper limit. If the idle-up degree increases more than the upper limit, in case of an automatic transmission, the vehicle may move undesirably.

In a step 104, the ECU 18 determines whether the combustion is good or bad. For instance, the knocking or a rough idle is detected by determining whether the engine rotation is stable or not. If the combustion is bad, the ECU 18 operates the actuators 15 and 17 to retard the valve timing by a small amount ΔDT in a step 105. The step 104 and 105 keeps the combustion within a good condition. If the combustion is good, the routine proceeds to a step 106.

In the step 106, the ECU 18 operates the actuators 15 and 17 to advance the valve timing by a small amount ΔDT. The step 106 is executed until an actual advance degree reaches to the target advance degree DT. Subsequently, in a step 107, the ECU 18 operates the idle control device 18*g* to increase the engine speed by a small amount ΔNT. The step 107 is executed until an actual idle-up degree reaches to the target idle-up degree NT.

In a step 108, it is determined that whether an actual advance degree reaches to the target advance degree DT determined in the step 103 and whether an actual idle-up degree reaches to the target idle-up degree NT determined in the step 103. If both of the actual degrees reach to the target degree DT and NT, the routine is finished.

According to the above-described control, the valve timing can be advanced up to a degree where the good combustion can be kept in the idling. Therefore, the vane rotor 7 may be able to be brought into the advance range by a small rotation angle when the stopping control means 18*c* is activated. Further, the engine speed is increased. Therefore, the pump 13 may supply an increased amount of oil and a higher oil pressure when the engine is operated to stop the rotation. As a result, it is possible to reduce possibilities that the vane rotor 7 is still in the retard range when the engine is completely stopped. It is possible to improve the starting of the engine, e.g. shortening the cranking time.

Second Embodiment

Figure 8:
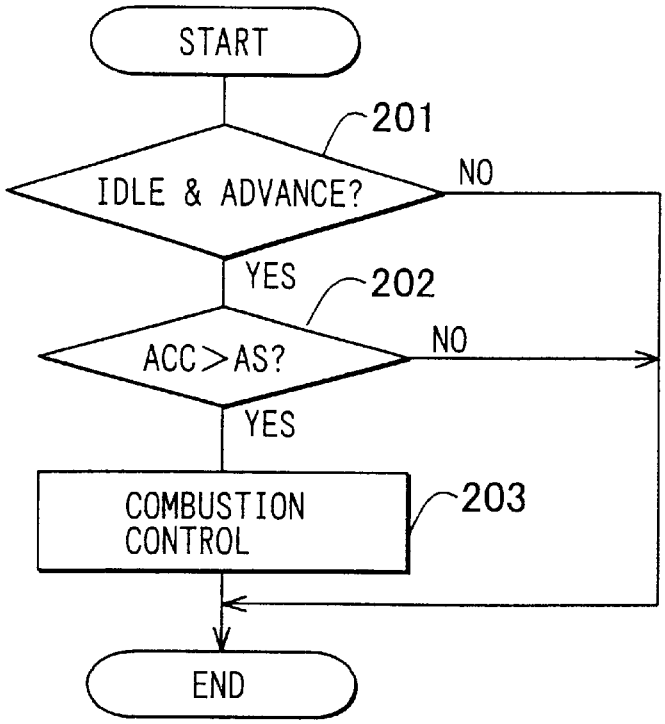
FIG. 8 is a flowchart showing a process in case of advancing a valve timing when an idling according to a second embodiment of the present invention.

In a second embodiment, the apparatus has a similar construction to the first embodiment, but the ECU 18 executes additional control. FIG. 8 shows a flowchart which is additionally executed in the ECU 18 when the engine is in the idling and a load of the engine is increased, e.g. the operator operates an accelerator pedal quickly. The ECU 18 provides a means for controlling the combustion to reduce the knocking or an unstable combustion.

If the operator operates the accelerator pedal quickly to accelerate the engine when the engine is in the idling and the valve timing of the intake valve is advanced, possibilities of an abnormal combustion such as the knocking is increased. To reduce this problem, in this embodiment, the ECU 18 executes a combustion stabilizing control.

In a step 201, the ECU 18 determines whether the engine is in the idling and the vane rotor 7 is not in the most retarded position. If the determination is positive, the ECU 18 determines whether an operating degree ACC of the accelerator pedal is more than a predetermined degree AS in a step 202. For instance, the ECU 18 detects that the engine has been operated from the idling to an accelerating condition or a load increasing condition.

If the determination is positive in the step 202, the ECU 18 executes at least one of combustion stabilizing operation in step 203. For example, an operation for preventing the knocking is executed. In this embodiment, at least one of the following operations is executed: (1) increasing an injection amount of fuel; (2) retarding an ignition timing; and (3) increasing a swirl in a combustion chamber.

According to this embodiment, the engine is prevented from the unstable combustion such as the knocking even if the operator accelerates the engine when the vane rotor 7 is not in the most retarded position in the idling.

Third Embodiment

In a third embodiment, the apparatus has a similar construction to the first embodiment. The ECU 18 executes the similar control to the first embodiment except for the step 106 in FIG. 5. The third embodiment doesn't have the step 106. Therefore, the ECU 18 just increases the engine speed when the oil temperature is high in the idling. Therefore, the pump 13 may supply an increased amount of oil and a higher oil pressure when the engine is operated to stop. As a result, it is possible to reduce possibilities that the vane rotor 7 is still in the retard range when the engine is completely stopped. It is possible to improve the starting of the engine, e.g. shortening the cranking time.

Fourth Embodiment

Figure 9:
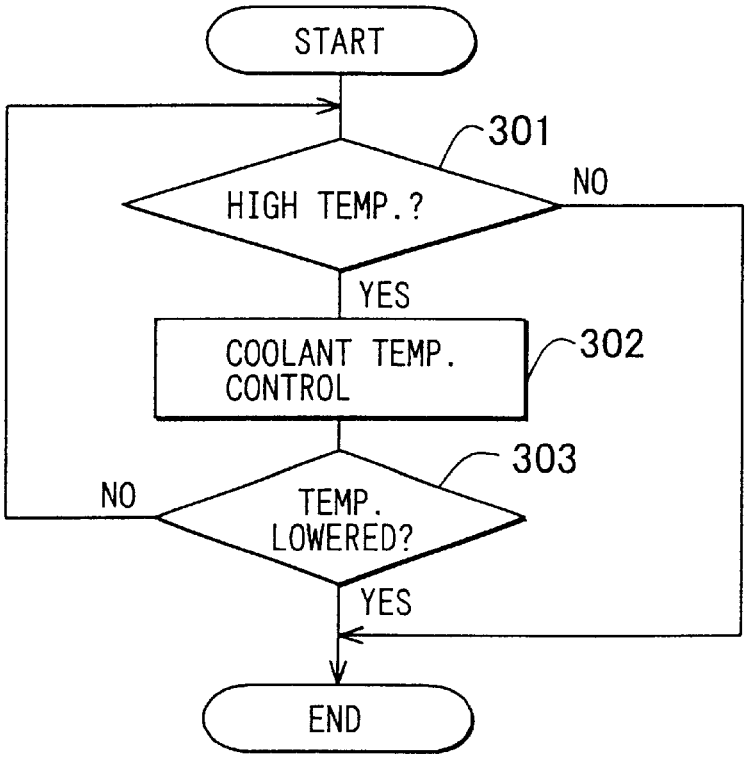
FIG. 9 is a flowchart showing a process in a high oil temperature according to a forth embodiment of the present invention.

The apparatus for controlling the valve timing of the engine according to the fourth embodiment has a similar construction to the first embodiment, but the ECU 18 executes an oil temperature decreasing control as shown in FIG. 9. The oil temperature decreasing control may be added or replaced to the control shown in FIG. 5.

In a step 301, the ECU 18 determines whether the oil temperature is high or not. For instance, the ECU 18 compares an actual oil temperature with a threshold value. If the actual oil temperature is higher than the threshold value, the ECU 18 executes at least one operation for decreasing a temperature of a coolant of the engine. In this embodiment, at least one of the following operations is executed: (1) lowering a combustion temperature by increasing an injection amount of the fuel; (2) retarding the ignition timing; or (3) turning on a heat exchanger for warming a passenger compartment. Since the coolant is used for cooling the engine, the oil temperature may be decreased as the coolant temperature decreases.

In a step 303, the ECU 18 determines that whether the oil temperature is lowered or not. For instance, the ECU 18 compares the actual oil temperature with a predetermined threshold value. Then, if the oil temperature is still high, the routine returns to the step 301. Therefore, the routine is repeated until the oil temperature is lowered. The threshold value in the step 303 may be set below a predetermined value that is an upper limit to be capable of rotating the vane rotor 7 to the advance range when the engine is stopped.

According to the fourth embodiment, the oil temperature is maintained below the predetermined value to maintain a viscosity. Therefore, the pump 13 may supply a sufficient amount and pressure of oil while the engine speed falls from an idling speed to stop. As a result, it is possible to reduce possibilities that the vane rotor 7 is still in the retard range when the engine is completely stopped. It is possible to improve the starting of the engine, e.g. shortening the cranking time.

Other Embodiment

Although the present invention is described based on the above-described embodiments, the embodiments may be modified as described below. The camshaft 1*d* may pass through the vane rotor 7 and be connected by a key or the like. The pin 20 may be urged toward the rear and engage with the sprocket 3. The pin 20 may be arranged to move in a radial direction. The pin 20 may be disposed in the shoe housing 2. It is also possible to arrange the vane rotor 7 being connected with the crankshaft and the shoe housing 2 being connected with the camshaft 1*d*.

The shoe housing 2 should have at least one cavity 6 for providing the advance and retard chambers. For instance, one, two, four or more cavities 6 may be arranged on the shoe housing 2.

The present invention can be applied to a VVT for varying a valve timing of an exhaust valve.

Although the present invention has been described in connection with the preferred embodiments thereof with reference to the accompanying drawings, it is to be noted that various changes and modifications will be apparent to those skilled in the art. Such changes and modifications are to be understood as being included within the scope of the present invention as defined in the appended claims.

What is claimed is:

1. An apparatus for controlling a valve timing of an engine, comprising:

a variable valve timing actuator having a hydraulic actuator which rotates a camshaft in an advance or retard direction relative to a crankshaft;

means for advancing the valve timing to at least a middle position when the engine is stopped; and means for preparing the advancing control of the advancing means before the engine is stopped, the means controlling the engine into a condition that helps to advance the valve timing by the advancing means;

wherein the advancing means has at least one of an assist spring which assist to rotate the camshaft in the advance direction, and means for controlling the hydraulic actuator to rotate the camshaft in the advance direction when the engine is stopped;

the preparing means comprises at least one of means for increasing an engine speed when the engine is in an idling and a temperature of an oil supplied to the hydraulic actuator is high, pre-advancing means for advancing the valve timing previously when the engine is in an idling and a temperature of an oil supplied to the hydraulic actuator is high, and means for decreasing a temperature of an oil supplied to the hydraulic actuator when the temperature of oil is high.

2. The apparatus for controlling the valve timing of the engine according to claim 1, wherein the pre-advancing means advances the valve timing till combustion of the engine becomes unstable.

3. The apparatus for controlling the valve timing of the engine according to claim 1, wherein the variable valve timing actuator includes a lock mechanism which mechanically locks the camshaft and the crankshaft in the middle position.

4. An apparatus for controlling a valve timing of an engine, comprising;

a variable valve timing actuator having a hydraulic actuator which rotates a camshaft in an advance or retard directions relative to a crankshaft;

means for advancing the valve timing to at least a middle position when the engine is stopped; and means for increasing an engine speed when the engine is in an idling and a temperature of an oil supplied to the hydraulic actuator is high.

5. The apparatus for controlling the valve timing of the engine according to claim 4, wherein the increasing means increases the engine speed by a predetermined degree that is increased as the temperature of the oil increases.

6. The apparatus for controlling the valve timing of the engine according to claim 4, further comprising pre-advancing means for advancing the valve timing previously to an advanced position from the most retarded position when the engine is in an idling and a temperature of an oil supplied to the hydraulic actuator is high.

7. The apparatus for controlling the valve timing of the engine according to claim 6, further comprising means for preventing the engine from an unstable combustion such as a knocking when the pre-advancing means advances the valve timing from the most retarded position.

8. The apparatus for controlling the valve timing of the engine according to claim 6, wherein the pre-advancing means advances the valve timing by a predetermined degree that is increased as the temperature of the oil increases.

9. The apparatus for controlling the valve timing of the engine according to claim 4, wherein the advancing means has at least one of an assist spring which assist to rotate the camshaft in the advance direction, and means for controlling the hydraulic actuator to rotate the camshaft in the advance direction when the engine is stopped.

10. The apparatus for controlling the valve timing of the engine according to claim 6, wherein the pre-advancing means advances the valve timing till combustion of the engine becomes unstable.

11. The apparatus for controlling the valve timing of the engine according to claim 4, wherein the variable valve timing actuator includes a lock mechanism which mechanically locks the camshaft and the crankshaft in the middle position.

12. An apparatus for controlling a valve timing of an engine, comprising;

a variable valve timing actuator having a hydraulic actuator which rotates a camshaft in an advance or retard directions relative to a crankshaft;

means for advancing the valve timing to at least a middle position when the engine is stopped; and means for decreasing a temperature of an oil supplied to the hydraulic actuator when the temperature of oil is high.

13. The apparatus for controlling the valve timing of the engine according to claim 12, wherein the decreasing means decreases a temperature of a coolant of the engine.

14. An apparatus for controlling a valve timing of an engine, comprising:

a variable valve timing actuator having a hydraulic actuator which rotates a camshaft in an advance or retard direction relative to a crankshaft;

means for advancing the valve timing to at least a middle position when the engine is stopped; and means for preparing the advancing control of the advancing means before the engine is stopped, the means controlling the engine into a condition that helps to advance the valve timing by the advancing means;

wherein the preparing means comprises at least one of means for increasing an engine speed when the engine is idling and a temperature of an oil supplied to the hydraulic actuator is high, pre-advancing means for advancing the valve timing previously when the engine is idling and a temperature of an oil supplied to the hydraulic actuator is high, and means for decreasing a temperature of an oil supplied to the hydraulic actuator when the temperature of oil is high.

15. The apparatus for controlling the valve timing of the engine according to claim 14, wherein the pre-advancing means advances the valve timing till combustion of the engine becomes unstable.

16. A method of controlling a valve timing of an engine, the method comprising:

providing a variable valve timing actuator having a hydraulic actuator which rotates a camshaft in an advance or retard direction relative to a crankshaft;

advancing the valve timing to at least a middle position when the engine is stopped; and increasing an engine speed when the engine is idling and a temperature of an oil supplied to the hydraulic actuator is high.

17. The method of controlling the valve timing of the engine according to claim 16, wherein the engine speed is increased by a predetermined degree that is increased as the temperature of the oil increases.

18. The method of controlling the valve timing of the engine according to claim 16, further comprising advancing the valve timing previously to an advanced position from the most retarded position when the engine is idling and a temperature of an oil supplied to the hydraulic actuator is high.

19. The method of controlling the valve timing of the engine according to claim 18, further comprising preventing the engine from an unstable combustion such as a knocking when the valve timing is advanced from the most retarded position.

20. The method of controlling the valve timing of the engine according to claim 18, wherein the valve timing is advanced by a predetermined degree that is increased as the temperature of the oil increases.

21. The method of controlling the valve timing of the engine according to claim 16, further comprising utilizing at least one assist spring to assist rotating the camshaft in the advance direction, and controlling the hydraulic actuator to rotate the camshaft in the advance direction when the engine is stopped.

22. The method of controlling the valve timing of the engine according to claim 18, wherein the valve timing is previously advanced till combustion of the engine becomes unstable.

23. The method of controlling the valve timing of the engine according to claim 16, mechanically locking the camshaft and the crankshaft in the middle position with a lock mechanism of the variable valve timing actuator.

24. A method of controlling a valve timing of an engine, the method comprising:

providing a variable valve timing actuator having a hydraulic actuator which rotates a camshaft in an advance or retard direction relative to a crankshaft;

advancing the valve timing to at least a middle position when the engine is stopped; and decreasing a temperature of an oil supplied to the hydraulic actuator when the temperature of oil is high.

25. The method of controlling the valve timing of the engine according to claim 24, further comprising decreasing a temperature of a coolant of the engine.

26. A method of controlling a valve timing of an engine, the method comprising:

providing a variable valve timing actuator having a hydraulic actuator which rotates a camshaft in an advance or retard direction relative to a crankshaft;

advancing the valve timing to at least a middle position when the engine is stopped; and preparing control of advancing the valve timing before the engine is stopped, the engine being controlled into a condition that helps to advance the valve timing;

wherein preparing control of advancing comprises at least one of increasing an engine speed when the engine is idling and a temperature of an oil supplied to the hydraulic actuator is high, advancing the valve timing previously when the engine is idling and a temperature of an oil supplied to the hydraulic actuator is high, and decreasing a temperature of an oil supplied to the hydraulic actuator when the temperature of oil is high.

27. The method of controlling the valve timing of the engine according to claim 26, wherein the valve timing is advanced previously till combustion of the engine becomes unstable.

* * * * *